United States Patent [19]

Courtney et al.

[11] Patent Number: 4,732,305

[45] Date of Patent: Mar. 22, 1988

[54] WEIGHT BELT FOR UNDERWATER DIVING

[75] Inventors: William L. Courtney, San Francisco; Philip W. Ford, San Rafael; Jay L. Kahn, Sausalito; John M. Patty, Berkeley; Daniel R. Rodarte, San Francisco, all of Calif.

[73] Assignee: Diver Designed Equipment, San Francisco, Calif.

[21] Appl. No.: 832,826

[22] Filed: Feb. 24, 1986

[51] Int. Cl.[4] ..... A45F 3/00; B63C 11/02

[52] U.S. Cl. ..... 224/224; 224/227; 405/186

[58] Field of Search ..... 224/901, 224, 253, 235, 224/236, 231; 2/312, 319; 405/186; 383/901

[56] References Cited

U.S. PATENT DOCUMENTS

| | | | |
|---|---|---|---|
| D. 29,490 | 10/1898 | Gardinier | 224/229 X |
| D. 134,542 | 12/1942 | Wax | 224/224 X |
| D. 259,151 | 5/1981 | Kishbaugh et al. | 224/901 X |
| 1,726,761 | 9/1929 | Palmer | 383/901 X |
| 3,158,300 | 11/1964 | Withee | 224/253 X |
| 3,374,636 | 3/1968 | Mason | 224/901 X |
| 3,470,570 | 10/1969 | Christiansen | 405/186 X |
| 3,713,299 | 1/1973 | Duncan | 405/186 |
| 3,808,824 | 5/1974 | Johnston et al. | 405/186 |
| 4,440,525 | 4/1984 | Perla | 224/901 X |
| 4,446,574 | 5/1984 | Kalomeris | 224/229 X |

*Primary Examiner*—James E. Bryant, III
*Assistant Examiner*—Robert M. Petrik
*Attorney, Agent, or Firm*—John A. Bucher

[57] ABSTRACT

Multiple embodiments of a diver's weight belt are disclosed having elongated panels of interconnected pockets for receiving and containing diving weights, the panels being interconnected by one or more belt portions and adjustable buckles or the like for positioning the panels about the diver's waist while permitting them to be adjustably positioned in centered relation on the diver's hips. The panels are preferably formed with multiple pockets facilitating arcuate arrangement of the panels about the diver's hips, a lower edge of each panel also having an arcuate configuration for conforming with the diver's hips, the panels also including neck structure for selectively filling the respective pockets.

10 Claims, 7 Drawing Figures

WEIGHT BELT FOR UNDERWATER DIVING

FIELD OF THE INVENTION

The present invention relates to underwater diving and more particularly to a weight belt for use by underwater divers.

BACKGROUND OF THE INVENTION

Weight belts are commonly worn by underwater divers for offsetting buoyancy of the diver and of scuba equipment and the like either worn or carried by the diver for use underwater.

Weight belts of the type referred to above are most commonly formed with a belt of webbing or the like secured about the diver's waist by an adjustable buckle and large solid weights formed from lead or the like held in place along the length of the belt so that the weights are arranged about the diver's waist in use.

More recently, soft weight belts have been developed which are generally elongated cylinders of different lengths for different divers. The cylinders are secured about the diver's waist and include means for filling the cylinder with diving weights.

Other prior art configurations for securing weights on underwater divers have been used particularly in combination with scuba gear or the like. In such arrangements, the diving weights can be attached directly to the scuba gear, for example an air tank so that the diving weights are supported on the diver along with other scuba equipment by conventional harness arrangements for the scuba gear.

It has been discovered that none of these prior art designs for diver's weight belts permits the diver to wear the weight belt either with or without different types of scuba gear for example while, at the same time, having the weight belt designed for greater versatility and maximum comfort for the diver. Accordingly, there has been found to remain a need for a diver's weight belt for meeting those requirements.

SUMMARY OF THE INVENTION

It is therefore an object of the invention to provide a weight belt which is adjustable in length and ergonomically designed for enhancing comfort of underwater divers.

It is a further object of the invention to provide such a weight belt including two elongated panels forming pockets for receiving and containing diving weights, and belt means for releasably securing the panels about the diver's waist, the belt means comprising adjustable means for adapting the weight belt to different waist sizes and for selectively positioning the panels in general centered relation on the diver's hips in a more comfortable configuration for the diver.

It is yet a further object of the invention to provide a weight belt of the type referred to above wherein the pockets are formed on the panels in a manner to facilitate their arcuate arrangement about the diver's hips.

It is an even further object of the invention to provide a weight belt of the type referred to above wherein lower edges of the panels are formed with arcuate configurations conforming with the diver's hips.

It is yet another object of the invention to provide a weight belt of the type referred to above while further including, either separately or in combination, one or more belt portions for adjustably securing the elongated panels about the diver's waist, filling necks which can be opened for filling the pockets of the panels and then closed and secured, auxiliary pocket means adapted for selectively increasing the overall weight of the weight belt and means for attaching accessories such as flashlights, cameras, etc. to the weight belt.

It is also an object of the invention to provide such a weight belt wherein the pockets are formed by the panels in a manner so that, upon being filled, they expand outwardly away from the diver to further facilitate arcuate arrangement of the panels about the diver's waist and also to further enhance diver comfort.

Additional objects and advantages of the invention are made apparent in the following description having reference to the accompanying drawings.

DESCRIPTION OF THE PREFERRED EMBODIMENTS

Figure 1:
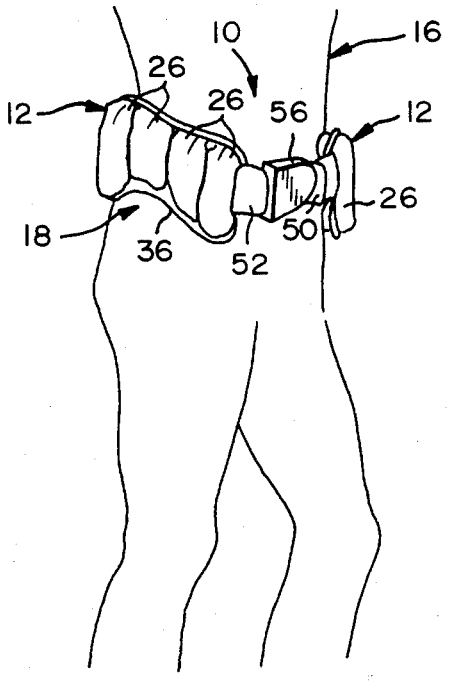
FIG. 1 is a fragmentary view of the weight belt of the invention secured to the waist of a diver while illustrating how the design and adjustability of each panel on the weight belt contributes to diver comfort.
Figure 2:
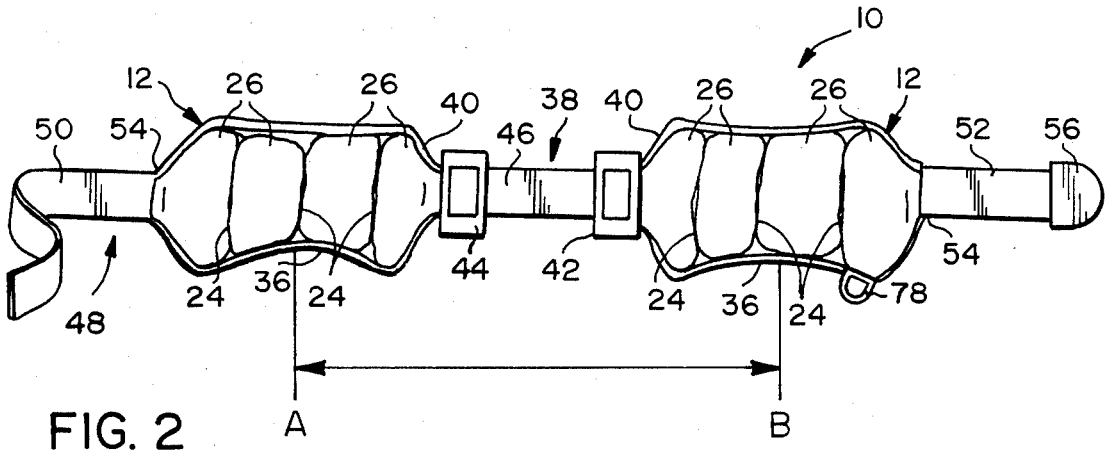
FIG. 2 illustrates one embodiment of a weight belt constructed according to the present invention while being fully extended to better illustrate its construction.

Referring now to the drawings, a weight belt of the type referred to above is generally indicated at 10 in each of FIGS. 1 and 2. Another embodiment of a weight belt including generally similar components as the weight belt 10 is indicated at 10' in FIG. 3.

The weight belt 10 of FIGS. 1 and 2 includes two elongated panels 12 which are of similar construction and are adapted to be held about a diver's waist by belt means 14. The diver is indicated at 16 in FIG. 1 with the point of one hip being indicated at 18. As will be described in greater detail below, either of the weight belts 10 or 10' is adapted for fitting divers of different waist sizes or even for fitting a single diver with or without a bulky wet suit for example.

To further facilitate comfort of the diver, the elongated panels 12 are adjustably secured on the belt means 14 so that they can be centered above each of the diver's hips 18 as indicated in FIG. 1.

Figure 3:
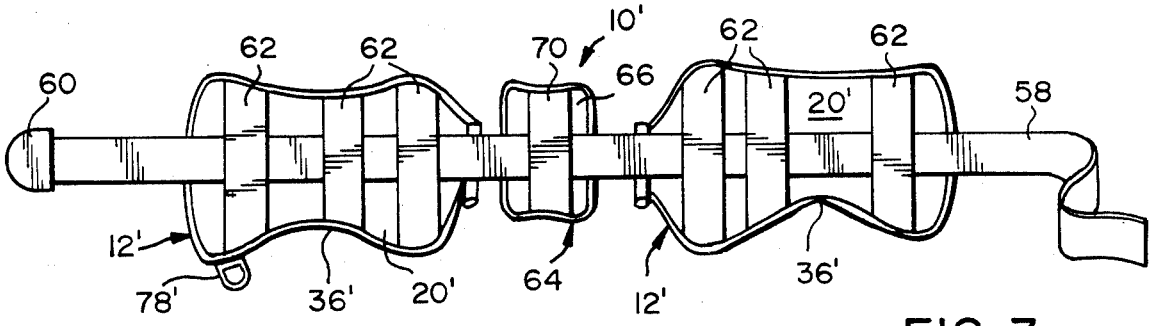
FIG. 3 is a similar view of another embodiment of the invention while also illustrating an auxiliary pocket permitting the diver to carry additional weights or other articles.

The embodiment of FIG. 3 includes generally similar features which are accordingly indicated by primed numerals in order to provide the same advantages in the embodiment of FIG. 3.

Figure 4:
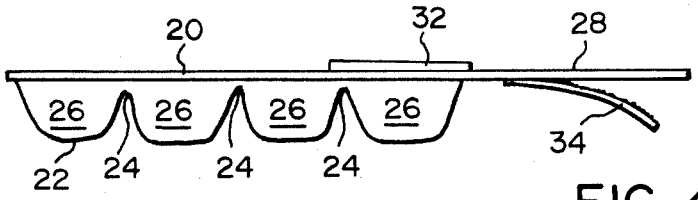
FIG. 4 is a top view of an elongated panel adapted for use either in the embodiment of FIG. 2 or the embodiment of FIG. 3 while illustrating a filling neck in an open position.

Before describing additional features of the weight belts 10 and 10', specific construction of the elongated panels 12 is described immediately below with reference to FIGS. 4–6.

Figure 5:
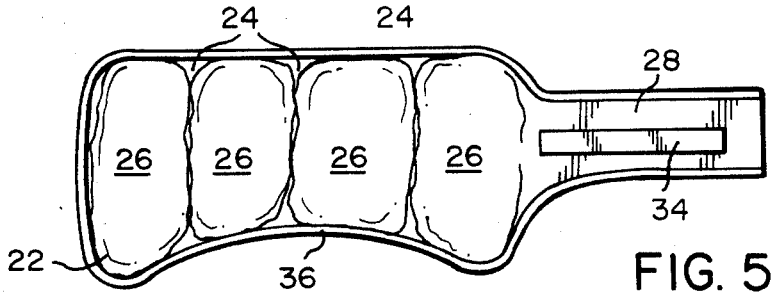
FIG. 5 is a side view of the elongated panel of FIG. 4.

Referring to those figures, each of the elongated panels 12 is formed with a flexible inner liner 20 having generally the same shape as illustrated for the elongated panel 12 in FIG. 5 for example. A flexible outer liner 22 has generally the same vertical dimension as the inner liner 20 as illustrated in FIG. 5. However, the lateral length of the outer liner 22 is substantially greater than that of the inner liner 20. In addition to being joined together by lateral and end seams, the inner and outer liners 20 and 22 are also joined together by partial seams 24 arranged in spaced apart relation along the length of the panel for forming pockets 26. The greater length of the outer liner 22 permits it to expand when diving weights are added to the individual pockets 26 as is best illustrated in FIG. 4. In this manner, the inner liner 20 remains generally smooth even when large masses of weights are added to the pockets 26. As illustrated in FIG. 4, the diving weights added to the pockets 26 tend to cause the outer liner 22 to expand outwardly away from the diver.

A filling neck 28 is formed by extensions of the inner and outer liners 20 and 22 to provide a means for inserting weights into the pockets 26. The partial construction of the seams 24 permits particulate weights to be added through the neck 28 and to enter into all of the pockets 26. After each panel is filled with particulate weights, the partial seams 24 act as baffles to prevent undesirable shifting of the weights.

Figure 6:
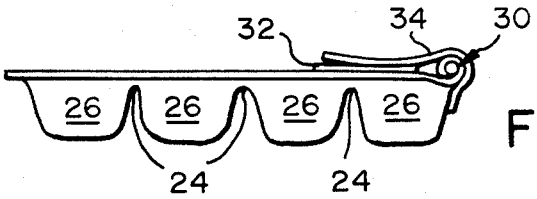
FIG. 6 is a top view similar to FIG. 4 but with the filling neck of the panel being closed and secured in place.

After the pockets of each panel 12 are filled as described with weights, the filling neck 28 may be closed for example by rolling it into the configuration indicated at 30 in FIG. 6. Means for closing the neck and securing it in its closed position preferably comprises separate fabric fasteners 34 respectively including hooks and loops, available for example under the trademark VELCRO. As illustrated in each of FIGS. 4 and 6, one fabric fastening panel 32 is secured on an inner surface of the panel adjacent the inner liner 20. Another fabric fastening panel 34 is secured to an outer portion of the panel, preferably the outer liner 22, so that it can be wrapped about the rolled neck 30 as illustrated in FIG. 6 and engaged with the other fabric panel 32 to secure the neck in its closed position.

In addition to the pockets 26 in each panel being configured for facilitating arrangement of the panels in arcuate relation about the diver's waist, a lower edge 36 of each panel 12 is formed with an arcuate configuration so that it better conforms with the diver's hip. Referring again to FIG. 1 and noting that the weight belt includes adjustable means for positioning the panels above the respective hips 18 of the diver, it may thus be seen how the arcuate configuration for the lower edge 36 of each panel causes the weight belt to conform to the diver's hips, thereby greatly enhancing diver comfort.

Referring again to FIG. 2, the belt means 14 comprises first adjustable means 38 for interconnecting to adjacent ends 40 of the respective panels. Preferably, the first adjustable means 38 is arranged at the diver's back and includes at least one adjustable buckle or slide fastener 42 for securing the adjacent ends 40 of the panels together either directly or in combination with an additional adjustable buckle or slide fastener 44 and a belt portion 46. With such a combination, the adjacent ends 40 of the panels could be secured together by the single fastener 42 particularly if the overall belt were to be relatively short. However, in order to adapt the panels for fitting persons of larger size, the combination of the two fasteners 42 and 44 together with the belt portion 46 permits substantial spacing between the adjacent ends 40 of the panels. At the same time, the fasteners 42 and 44 provide means for closing filling necks such as that indicated at 28 in FIGS. 4–6.

Numerous modifications are immediately apparent for the first adjustable means 38. For example, one of the fasteners, such as that indicated at 42, could serve both to join the adjacent ends of the panels together while also closing the filling necks 28 for each panel. Alternatively, if other means were provided for closing and securing the filling neck as described above with respect to FIGS. 4–6, it would then also be possible to directly secure the belt portion 46 to the adjacent end 40 of one panel with only a single fastener 42 providing adjustability between the panels.

A second adjustable means 48 comprises belt portions 50 and 52 secured respectively to the adjacent ends 54 of the panels opposite their adjacent ends 40. An adjustable buckle 56 then permits releasable engagement between the belt portions 50 and 52 while also permitting adjustment in the spacing between the adjacent ends 54 of the two panels.

In this manner, both the first adjustable means 38 and the second adjustable means 48 permit adjustment of the panels 12 so that they may both be positioned directly above the respective hips 18 of the diver. In that regard, referring in combination to FIGS. 1 and 2, the locations of the diver's hips are indicated schematically at A and B in FIG. 2. Positions A and B correspond with the center of the arcuate depressions 36 in the respective panels. Accordingly, it is immediately apparent that by varying spacing between the adjacent ends 40 of the panels through the first adjustable means 38, the length of a rear portion of the belt between positions A and B can be adjusted to accommodate divers of different sizes or a single diver for example either with or without bulky diving equipment such as a wet suit. Similar adjustment is of course possible in a front potion of the belt through the second adjustable means 48 for the same purpose.

Referring now to FIG. 3, the weight belt 10′ includes panels 12′ which are of substantially similar construction as the panels 12 illustrated in FIGS. 1, 2, and 4–6. In the embodiment of FIG. 3, the belt means 14′ is formed as a single elongated belt of webbing or the like as indicated at 58. An adjustable buckle 60 provides the same adjustment and releasable features as the buckle 56 in FIG. 2.

In order to adjustably position the panels 12′ upon the single belt 58, loops 62 are secured in spaced apart relation to the inner liner 20′ of each of the panels 12′. With the belt 58 being threaded through the loops 62, the respective panels 12′ may then accordingly be adjustably positioned relative to the belt and relative to each other for positioning in the same manner described above with reference to FIGS. 1 and 2.

Figure 7:
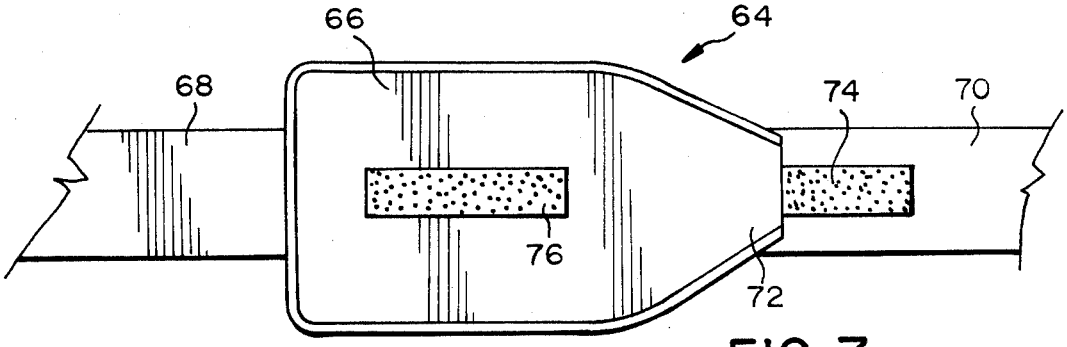
FIG. 7 is a fragmentary view of the auxiliary pocket also illustrated in FIG. 3, the auxiliary pocket being shown in extended fashion to better illustrate its construction.

In order to make the weight belt 10′ even more adaptable to a variety of diving situations, an auxiliary pocket assembly 64 can also be attached to the belt 58 either to carry additional diving weights if desired or even to carry other accessory items. The auxiliary pocket assembly 64 is also illustrated in FIG. 7 and includes a single pocket 66 with fabric fasteners 68 and 70 secured to opposite ends of the pocket 66 and adapted to be wrapped around the belt 58 and secured with each other. The fasteners 68 and 70 may be of similar construction as the fabric fasteners 32 and 34 described above with reference to FIGS. 4–6.

The auxiliary pocket 66 also includes a filling neck 72 and fabric fasteners 74 and 76 which function to close and secure the filling neck 72 in the same manner described above with respect to FIG. 6. It will also be apparent that the auxiliary pocket assembly 64 could also be used with the weight belt embodiment 10 of FIGS. 1 and 2.

In order to provide further versatility for the weight belt of the present invention, clips or loops preferably in the form of D-rings, such as that indicated at 78 are provided for attaching accessories such as flashlights, cameras, etc. to the weight belt.

Accordingly, there has been disclosed above two embodiments of a weight belt which are of particularly novel construction while being adaptable for divers of different sizes and configured for greatly enhancing diver comfort. Numerous modifications and variations are believed apparent in addition to those noted above. Accordingly, the scope of the present invention is defined only by the following appended claims.

What is claimed is:

1. A weight belt for underwater divers, comprising two similar flexible elongated panels forming a plurality of generally contiguous pockets for receiving and containing diving weights, said panels comprising an inner flexible liner adapted for arrangement next to the diver and an outer liner, seams being formed between the inner and outer liners to form the respective pockets and for allowing expansion of the pockets when they are filled with diving weights so that the pockets tend to expand outwardly upon being filled to further enhance the comfort of the diver, the lower edge of each elongated panel being formed with an arcuate configuration to conform to the hips of the diver, and belt means comprising releasable means and adjustable means for securing the panels about the diver's waist and selectively positioning the panels relative to the belt means, whereby the weight belt can be adjusted to accommodate different waist sizes with the arcuate lower edge of each elongated panel being respectively centered on the diver's hips.

2. The weight belt of claim 4 wherein the belt means comprises first adjustable means interconnecting two ends of the elongated panels and second adjustable and releasable means interconnecting the other ends of the panels.

3. The weight belt of claim 2 wherein the adjustable and releasable means comprises belt portions secured to the other ends of the panels and an adjustable buckle means for releasably securing the belt portions.

4. The weight belt of claim 3 wherein the first adjustable means comprises an additional belt portion respectively secured to the ends of the elongated panels by adjustable buckle means.

5. The weight belt of claim 4 wherein each of the elongated panels is formed with an elongated filling neck for adding particulate weights to the pockets of the respective panels, the adjustable buckle means being adapted for closing and securing the elongated filling necks of the respective panels.

6. The weight belt of claim 2 wherein each of the elongated panels comprises an elongated filling neck for adding particulate weights to its pockets, the elongated filling necks being closed and secured by the first adjustable means.

7. The weight belt of claim 1 wherein the belt means comprises a continuous belt of webbing or the like for encircling the diver's waist, the releasable means comprising buckle means for securing the belt about the diver's waist, the adjustable means comprising loop means for securing the elongated panels on the belt and for allowing them to be centered on the diver's hips.

8. The weight belt of claim 1 further comprising an auxiliary pocket and means for releasably securing the auxiliary pocket on the weight belt.

9. The weight belt of claim 8 wherein the auxiliary pocket comprises neck means permitting access to the auxiliary pocket, the auxiliary pocket further comprising mean for closing and securing the neck means.

10. The weight belt of claim 1 wherein the outer flexible liner for each elongated panel has a substantially greater length than the inner flexible liner.

* * * * *